US009743474B2

(12) United States Patent
Scheidegger et al.

(10) Patent No.: US 9,743,474 B2
(45) Date of Patent: Aug. 22, 2017

(54) METHOD AND SYSTEM FOR LIGHTING INTERFACE MESSAGING WITH REDUCED POWER CONSUMPTION

(71) Applicant: General Electric Company, Schentectady, NY (US)

(72) Inventors: Nina Rose Scheidegger, Cleveland, OH (US); Jessica Lynn Burk, Mayfield Village, OH (US); Benoit Essiambre, Boisbriand (CA); Gang Yao, ShangHai (CN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 71 days.

(21) Appl. No.: 14/541,470

(22) Filed: Nov. 14, 2014

(65) Prior Publication Data

US 2016/0143106 A1 May 19, 2016

(51) Int. Cl.

| | |
|---|---|
| ***H05B 33/08*** | (2006.01) |
| *H05B 41/392* | (2006.01) |
| *H05B 41/36* | (2006.01) |
| *H05B 41/38* | (2006.01) |
| *H05B 37/02* | (2006.01) |

(52) U.S. Cl.

CPC ..... *H05B 33/0845* (2013.01); *H05B 37/0254* (2013.01); *H05B 37/0263* (2013.01); *H05B 41/36* (2013.01); *H05B 41/38* (2013.01); *H05B 41/3924* (2013.01); *H05B 41/3927* (2013.01)

(58) Field of Classification Search

CPC ..... H05B 37/0254; H05B 41/36; H05B 37/0263; H05B 41/38; H05B 41/3924; H05B 33/0845; H05B 41/3927; H02J 9/005

USPC ..... 315/291–296, 224, 225, 307, 362, 312, 315/318, 320, 324

See application file for complete search history.

(56) References Cited

U.S. PATENT DOCUMENTS

| | | | | |
|---|---|---|---|---|
| 6,762,570 | B1 * | 7/2004 | Fosler | H05B 37/0254 315/294 |
| 7,705,546 | B2 * | 4/2010 | Juen | H05B 37/0254 315/307 |
| 8,072,164 | B2 * | 12/2011 | Ilyes | H05B 37/0254 315/307 |
| 8,866,401 | B2 * | 10/2014 | Shearer | H05B 37/0263 315/246 |

(Continued)

FOREIGN PATENT DOCUMENTS

| | | | |
|---|---|---|---|
| WO | 02082283 | A2 | 10/2002 |
| WO | 02082618 | A1 | 10/2002 |
| WO | 2009118123 | A2 | 10/2009 |

OTHER PUBLICATIONS

PCT Search Report and Written Opinion issued in connection with corresponding PCT Application No. PCT/US2015/059902 on Mar. 16, 2016.

*Primary Examiner* — Thai Pham
*Assistant Examiner* — Borna Alaeddini
(74) *Attorney, Agent, or Firm* — GE Global Patent Operation; Peter T. DiMauro

(57) ABSTRACT

Provided is a system for reducing power consumption in digitally addressable lighting interfaces (DALI), the system including a processor having at least one pin, a transistor coupled to the processor and a resistive network coupled to the processor and the resistive network.

20 Claims, 4 Drawing Sheets

(56) References Cited

U.S. PATENT DOCUMENTS

| | | | | |
|---|---|---|---|---|
| 2004/0225811 | A1* | 11/2004 | Fosler | H05B 37/0254 710/305 |
| 2008/0258551 | A1* | 10/2008 | Chitta | H04L 25/028 307/3 |
| 2010/0277072 | A1* | 11/2010 | Draper | H05B 37/0218 315/149 |
| 2012/0262950 | A1* | 10/2012 | Nate | H02J 9/005 363/16 |
| 2013/0119892 | A1* | 5/2013 | Feri | H05B 37/0209 315/293 |
| 2014/0028199 | A1* | 1/2014 | Chemel | H05B 33/0854 315/152 |
| 2014/0056040 | A1* | 2/2014 | Larosa | H02M 1/36 363/49 |

* cited by examiner

METHOD AND SYSTEM FOR LIGHTING INTERFACE MESSAGING WITH REDUCED POWER CONSUMPTION

FIELD OF THE INVENTION

The present invention relates generally to lighting interfaces such as digitally addressable lighting interfaces (DALI). More particularly, the present invention relates to systems and methods for delivering data to DALI controllers implementing low power consumption.

BACKGROUND OF THE INVENTION

A typical lighting system can include a luminaire, that is, a series of one or more light emitting diode (LED) bulbs, having a power supply (e.g., a LED driver) and a controller, which can include a DALI network.

In general, a DALI network includes a controller and one or more lighting devices (e.g., electrical ballasts and dimmers) that have DALI interfaces. The controller can monitor and control each light by means of a bi-directional data exchange. The DALI protocol permits devices to be individually addressed and it also incorporates Group and Scene broadcast messages to simultaneously address multiple devices.

Each lighting device is assigned a unique static address in the numeric range 0 to 63, making possible up to 64 devices in a standalone system. Alternatively, DALI can be used as a subsystem via DALI gateways to address more than 64 devices. Data is transferred between controller and devices by means of an asynchronous, half-duplex, serial protocol over a two-wire bus, with a fixed data transfer rate of 1200 bit/s.

DALI requires a single pair of wires to form the bus for communication to all devices on a single DALI network. The network can be arranged in a bus or star topology, or a combination of these. The DALI System is not classified as separated extra low voltage (SELV) and therefore may be run next to the mains cables or within a multi-core cable that includes mains power. The DALI data is transmitted using manchester encoding and has a high signal to noise ratio, which enables reliable communications in the presence of a large amount of electrical noise.

DALI employs a diode bridge in the interface circuitry so that devices can be wired without regard for polarity. Signal level are defined as 0±4.5 V for "0" and 16±6.5 V for "1". Central interface power maximum is 250 mA and 2 mA per unit. The network cable is required to be mains-rated, with 600 V isolation and at least a 1 mm cross-section, with a maximum drop of 2 volts along the cable (max 300 m). Signal interface is galvanically separated and doesn't need any termination resistors.

Earlier generations of DALI devices stored configuration data in EEPROM, which was problematic due to the limited number of write cycles supported by EEPROMs. In current generations of DALI devices, RAM is used in preference to EEPROM during normal operation, which significantly reduces the number of EEPROM writes and thus extends their lifetimes.

In the lighting system, the control system sends messages to a microcontroller in the DALI to for commands such as to power on and power off the luminaire. When the luminaire is powered off, the microcontroller in the DALI goes into a low power mode. It is important that the DALI is still able to receive messages and respond to commands from the controller when the microcontroller is in the low power mode. Often, when in the low power mode, the microcontroller is not able to respond to commands.

SUMMARY OF EMBODIMENTS OF THE INVENTION

Given the aforementioned deficiencies, a need exists for a system and method the enables a DALI driver to have good performance for receiving DALI messages in normal operation while also having very low power consumption for the driver during standby mode to meet power consumption limitations.

Embodiments of the present invention include a system for reducing power consumption in a DALI, the system including a processor having at least one pin, a transistor coupled to the processor and a resistive network coupled to the processor and the resistive network.

Another embodiment of the present invention include a method for reducing power consumption in a lighting interface, the method including configuring a processor having at least one pin, to be in a normal mode to send and receive lighting messages responsive a first voltage signal from a transistor coupled to the processor, thereby placing a lighting interface in a normal operating mode and turning on a luminaire, and configuring the processor to be in a standby mode with reduced power consumption to send and receive lighting messages, responsive to a second voltage signal from the transistor indicating, thereby placing the lighting interface into a reduced power mode and turning off the luminaire.

In yet another embodiment, the present invention includes a system for reducing power consumption in a DALI, the system including an LED driver, a DALI controller communicatively coupled to the LED driver; and a luminaire coupled to the LED driver, wherein the LED driver is configured to be placed in a normal mode and a standby mode.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS

The accompanying drawings, which are incorporated herein and form part of the specification, illustrate the present invention and, together with the description, further serve to explain the principles of the invention and to enable a person skilled in the relevant art(s) to make and use the invention.

DETAILED DESCRIPTION OF EMBODIMENTS OF THE INVENTION

While the present invention is described herein with illustrative embodiments for particular applications, it should be understood that the invention is not limited thereto. Those skilled in the art with access to the teachings provided herein will recognize additional modifications, applications, and embodiments within the scope thereof and additional fields in which the invention would be of significant utility.

In exemplary embodiments, the systems and methods described herein enable a DALI driver to have good performance for receiving DALI messages in normal operation, while also having very low power consumption for the driver during standby mode to meet power consumption limitations. In exemplary embodiments, a microcontroller is implemented to encode and decode DALI messages. As further described here, an additional digital pin is manipulated depending on the state of the driver.

Figure 1:
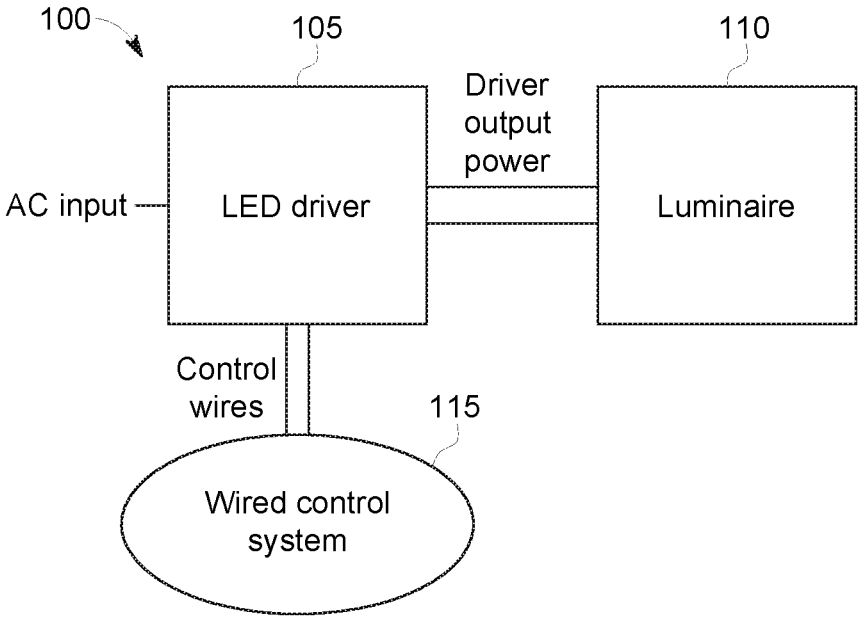
FIG. 1 is an illustration of a high level operational view of an exemplary lighting system for DALI messaging with reduced power consumption.

FIG. 1 illustrates an overall system level diagram of an exemplary lighting system 100. The system 100 includes an LED driver (i.e., power supply) 105, which includes a DALI interface as further described here. The system 100 further includes a luminaire 110, that is, a series of one or more LEDs bulbs or other DALI devices. The system 100 further includes a DALI controller 115, which can be any type of controller, microcontroller, microprocessor or other computing system. In exemplary embodiments, the controller 115 is communicatively and electrically coupled to the LED driver 105, such as by control wires, and configured to send DALI messages to the LED driver 105 as described herein.

In particular, the controller 115 sends messages to a microcontroller in the DALI interface of the LED driver 110 to for commands such as to power on and power off the luminaire 110, or dimming the luminaire 110. The LED driver 105 is further communicatively and electrically coupled to the luminaire 110, for example, to power on and off individual or groups of LEDs in the luminaire 110. As further described herein, when the luminaire 110 is powered off, the microcontroller in the LED driver 105 (e.g., the DALI) goes into a low power mode.

In exemplary embodiments, the DALI is still able to receive messages and respond to commands from the controller 115 when the microcontroller is in the low power mode. Conventionally, when in the low power mode, the microcontroller is not able to respond to commands. It is appreciated that the system 100 can include multiple LED drivers such as the LED driver 105, and luminaire systems such as the luminaire 110, all of which are controlled by the same controller 115.

In exemplary embodiments, the systems and methods described herein enable the LED driver 105 and DALI to receive DALI messages from the controller 115 in normal operation while also having very low power consumption for the LED driver 105 during standby mode to meet power consumption limitations. As further described herein, a microcontroller in the LED driver 110 encodes and decodes DALI messages from the controller 115.

Figure 2:
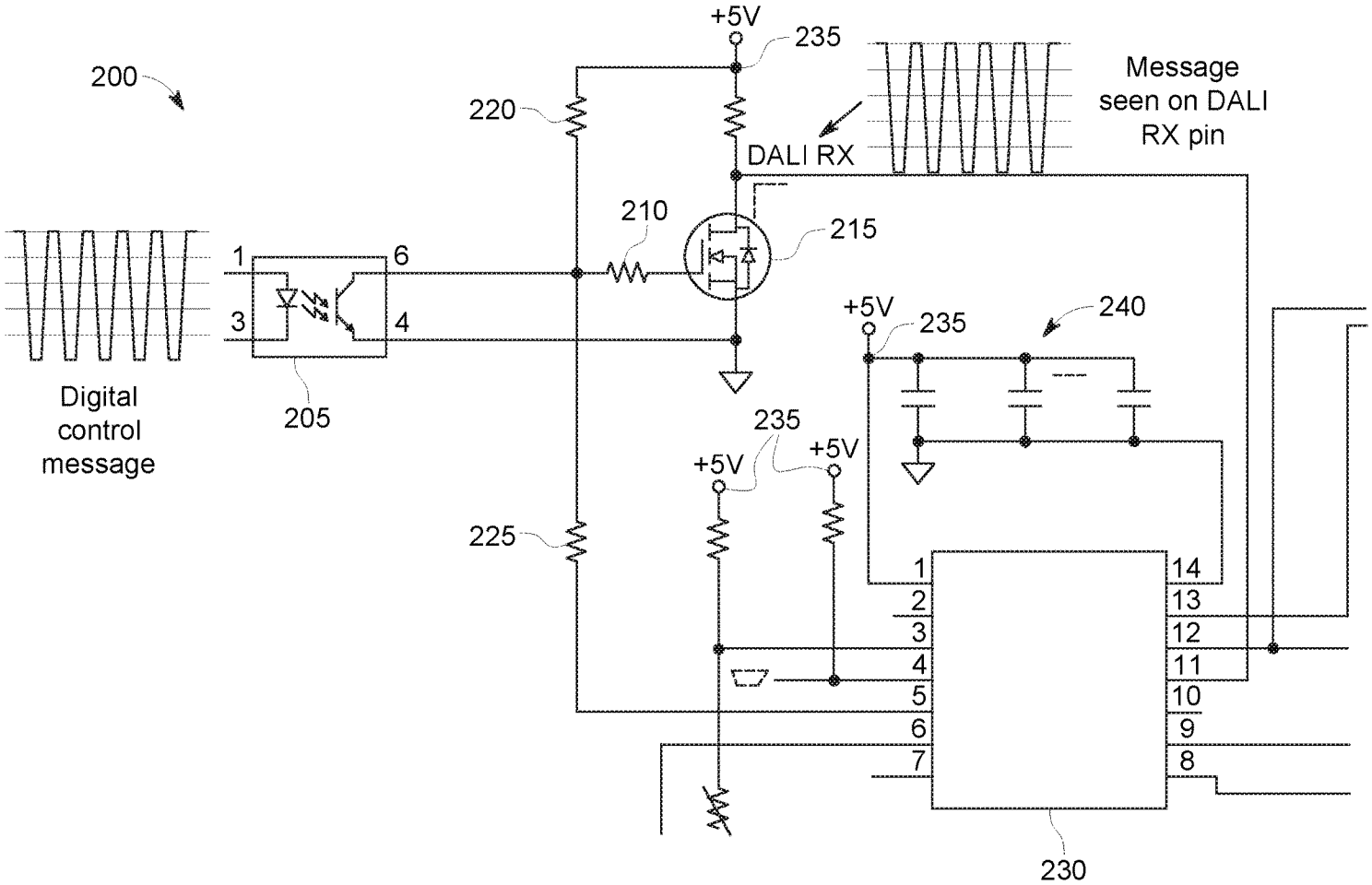
FIG. 2 illustrates a portion of a DALI network of the LED driver of FIG. 1.

FIG. 2 illustrates a portion of a DALI system 200 of the LED driver 105 of FIG. 1. The system 200 includes an opto-coupler 205 that is configured to receive DALI messages from the controller 115, and provides isolation between the LED driver 105 electronics and the DALI controller 115. The opto-coupler 205 is electrically coupled to an input resistor 210 for a transistor (e.g., a metal on oxide field effect transistor (MOSFET)) 215 for receiving the DALI messages.

In one embodiment, the transistor 215 operates as a switch that opens and closes to communicate the DALI message sent through the opto-coupler 205 to a processor 230, further described here. For example, when the transistor 215 is open, the processor 230 receives a HIGH (5V) signal from a +5V power supply source 235, and when the transistor 215 is closed, the processor 230 receives a LOW (0V) signal from the +5V power supply source 235.

The system 200 further includes resistors 220, 225 that are configured as a resistor network connected electrically to the input resistor 210. In one embodiment, the resistor 220 and the resistor 225 in parallel is the resistance from the +5V power supply source 235 to the transistor 215 when the system 200 is in normal operation as further described herein. In one embodiment, the resistor 225 is the resistor that is switched in and out of the circuit of the system 200 (i.e., being in parallel to the resistor 220 lowers total resistance from the +5V power supply source 235 to the gate of the transistor 215) as further described herein. The resistor 225 being switched out of the circuit increases the impedance seen by the gate of transistor 215 and lowers power consumption for standby mode.

The system 200 further includes the processor 230 communicatively and electrically coupled to the transistor 215 at PIN11 of the processor 230, for receiving and performing the DALI messages, and to transmit responses to the controller 115.

The processor is further communicatively and electrically coupled to the resistor 225 at PIN5, which is configured to switch the resistor 225 into and out of the circuit as further described herein. The processor 230 further receives power, Vdd, Vss, from the +5V power supply source 235, via PIN1 and PIN14 respectively, and through a capacitive filter 240. PIN6 is configured to transmit a DALI message. The pin out description of the processor 230 is for illustrative purposes. It is appreciated that in other embodiments, the pin outs can be mapped in different configurations and processors with other pin outs can be implemented. The processor 230 can be, but not limited to, a microcontroller, a microprocessor, digital signal processor, digital signal controller, an application specific integrated circuit (ASIC), a programmable logic array (PLA) and the like.

Figure 3:
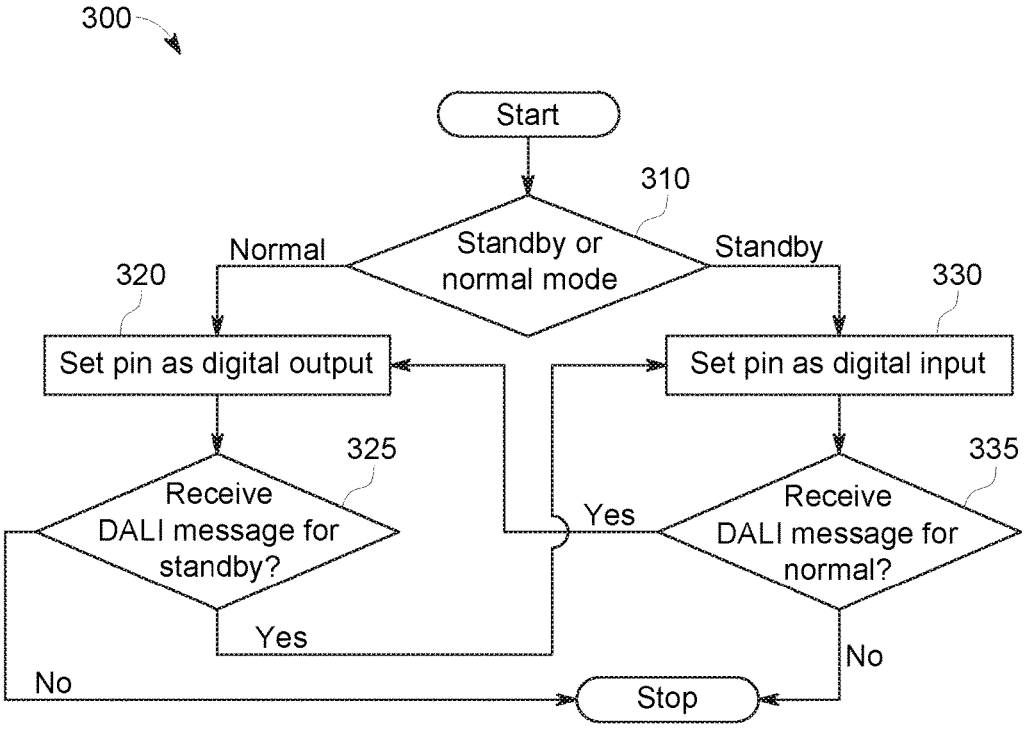
FIG. 3 is a block diagram illustration of a flowchart of a method for DALI messaging with reduced power consumption.

FIG. 3 is a block diagram illustration of a flowchart of a method 300 for DALI messaging with reduced power consumption. It will be appreciated that the systems and methods described herein have various DALI functionality. The method 300 describes the portion of operation of the systems 100, 200 for normal and standby modes for reduced power consumption.

In exemplary embodiments, the systems and methods described herein implement the processor 230, the resistors 220, 225 and the transistor 215 to control the receiving of a DALI messages to the driver from the controller 115 (FIG. 1). At block 310, the method 300 determines whether the system 200 is in a normal or standby mode. In one embodiment, if the method determines the system 200 is in normal mode, then at block 320, during normal operation (i.e., when the LED driver 105 is not in standby mode), PIN5 connected to the resistor 225 is defined as an output pin and is driven high (VDD) to the gate of the transistor. In this mode of operation, the resistor 220 is connected in parallel with the resistor 225 to reduce the parallel resistance to allow more current to flow to the DALI message RX circuit, which is the gate of the transistor 215. In this configuration, a DALI message applied to the gate-source of the transistor 215, can be seen at the drain-source of the transistor to be decoded at the processor 230. At block 325, the method 300 determines if the system 200 receives DALI messages for standby mode. If at block 325, the method 300 determines that the system 200 receives a DALI message for standby mode, then the flow proceeds to block 330 as now further described.

If the method determines the system 200 is in normal mode at block 310 and/or if at block 325, the method 300 determines that the system 200 receives a DALI message for standby mode, then at block 330, in another embodiment, during standby mode, PIN5 of the processor 230 is set as a digital input (i.e., high impedance), thus taking the resistor 225 out of the circuit of the system 200. The resistance is higher from the +5V power supply source 235 to the gate of the transistor 215 and the power consumption becomes lower, which allows for lower power consumption to be seen during this standby mode while also allowing messages on the gate-source to be seen at the processor 230. At block 335, the method 300 determines if the system 200 receives DALI messages for normal mode. If at block 335, the method 300 determines that the system 200 receives a DALI message for normal mode, then the flow proceeds to block 320 as described above.

When a message is sent from the controller 115, the processor 230 then flips PIN5 back to a digital output pin. Without changing this back to a digital output pin, the message over time will become distorted and will not be received by the processor 230. After this time, the processor sets PIN5 to be a digital input or output based on if it is to be in standby mode or not.

Figure 4:
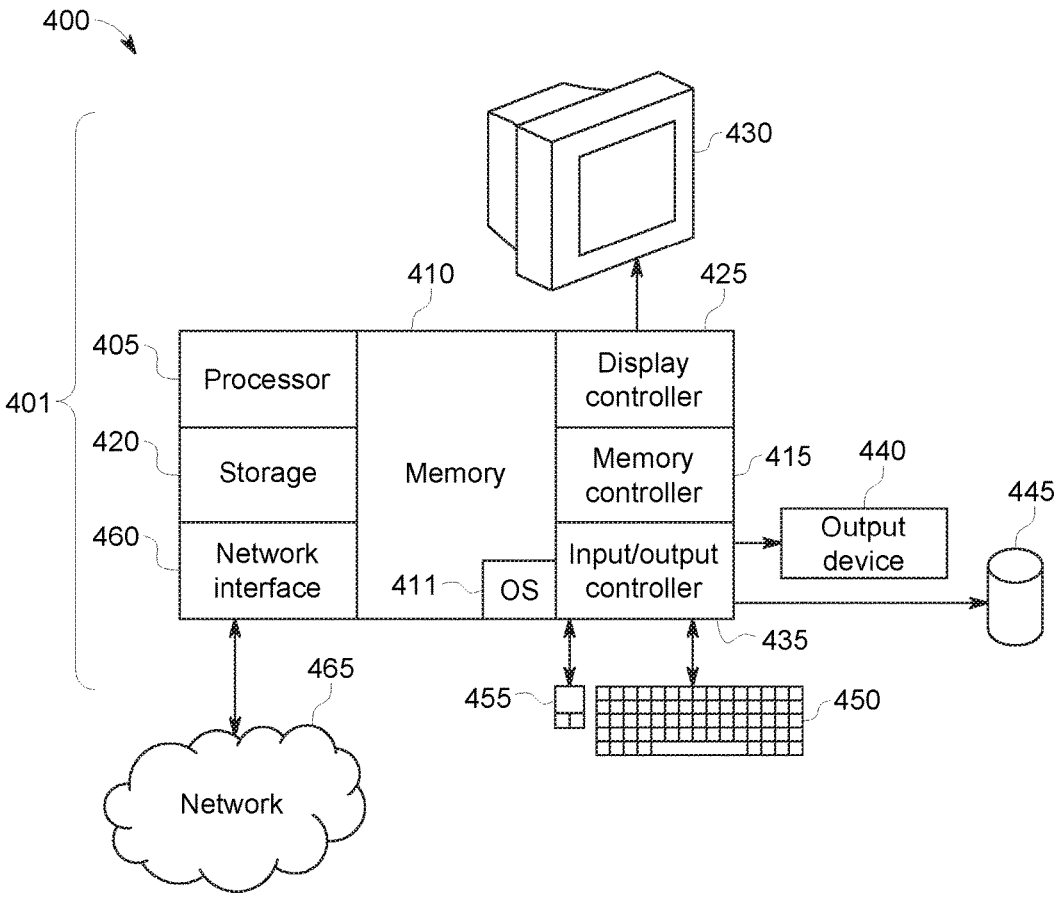
FIG. 4 illustrates an exemplary embodiment of a computing system that can be implemented for the DALI control methods described herein.

As described herein, the DALI controller 115 is any suitable computing system. FIG. 4 illustrates an exemplary embodiment of a computing system 400 that can be implemented for the DALI control methods described herein. The methods described herein can be implemented in software (e.g., firmware), hardware, or a combination thereof. In exemplary embodiments, the methods described herein are implemented in software, as an executable program, and is executed by a special or general-purpose digital computer, such as a personal computer, workstation, minicomputer, or mainframe computer. The system 400 therefore includes general-purpose computer 401.

In exemplary embodiments, in terms of hardware architecture, as shown in FIG. 4, the computer 401 includes a processor 405, memory 410 coupled to a memory controller 415, and one or more input and/or output (I/O) devices 440, 445 (or peripherals) that are communicatively coupled via a local input/output controller 435. The input/output controller 435 can be, but is not limited to, one or more buses or other wired or wireless connections, as is known in the art.

The input/output controller 435 may have additional elements, which are omitted for simplicity, such as controllers, buffers (caches), drivers, repeaters, and receivers, to enable communications. Further, the local interface may include address, control, and/or data connections to enable appropriate communications among the aforementioned components.

The processor 405 is a hardware device for executing software, particularly that stored in memory 410. The processor 405 can be any custom made or commercially available processor, a central processing unit (CPU), an auxiliary processor among several processors associated with the computer 401, a semiconductor based microprocessor (in the form of a microchip or chip set), a macroprocessor, or generally any device for executing software instructions. The processor 230 can also be, but not limited to, a microcontroller, a microprocessor, digital signal processor, digital signal controller, an application specific integrated circuit (ASIC), a programmable logic array (PLA) and the like.

The memory 410 can include any one or combination of volatile memory elements (e.g., random access memory (RAM, such as DRAM, SRAM, SDRAM, etc.)) and non-volatile memory elements (e.g., ROM, erasable programmable read only memory (EPROM), electronically erasable programmable read only memory (EEPROM), programmable read only memory (PROM), tape, compact disc read only memory (CD-ROM), disk, diskette, cartridge, cassette or the like, etc.). Moreover, the memory 410 may incorporate electronic, magnetic, optical, and/or other types of storage media. Note that the memory 410 can have a distributed architecture, where various components are situated remote from one another, but can be accessed by the processor 405.

The software in memory 410 may include one or more separate programs, each of which comprises an ordered listing of executable instructions for implementing logical functions. In the example of FIG. 4, the software in the memory 410 includes the DALI control methods described herein in accordance with exemplary embodiments and a suitable operating system (OS) 411. The OS 411 essentially controls the execution of other computer programs, such the DALI control systems and methods as described herein, and provides scheduling, input-output control, file and data management, memory management, and communication control and related services.

The DALI control methods described herein may be in the form of a source program, executable program (object code), script, or any other entity comprising a set of instructions to be performed. When a source program, then the program needs to be translated via a compiler, assembler, interpreter, or the like, which may or may not be included within the memory 410, so as to operate properly in connection with the OS 411. Furthermore, the DALI control methods can be written as an object oriented programming language, which has classes of data and methods, or a procedure programming language, which has routines, subroutines, and/or functions.

In exemplary embodiments, a conventional keyboard 450 and mouse 455 can be coupled to the input/output controller 435. Other output devices such as the I/O devices 440, 445 may include input devices, for example but not limited to a printer, a scanner, microphone, and the like. Finally, the I/O devices 440, 445 may further include devices that communicate both inputs and outputs, for instance but not limited to, a network interface card (NIC) or modulator/demodulator (for accessing other files, devices, systems, or a network), a radio frequency (RF) or other transceiver, a telephonic interface, a bridge, a router, and the like.

The system 400 can further include a display controller 425 coupled to a display 430. In exemplary embodiments, the system 400 can further include a network interface 460 for coupling to a network 465. The network 465 can be an IP-based network for communication between the computer 401 and any external server, client and the like via a broadband connection. The network 465 transmits and receives data between the computer 401 and external systems. In exemplary embodiments, network 465 can be a managed IP network administered by a service provider. The network 465 may be implemented in a wireless fashion, e.g., using wireless protocols and technologies, such as WiFi, WiMax, etc.

The network 465 can also be a packet-switched network such as a local area network, wide area network, metropolitan area network, Internet network, or other similar type of network environment. The network 465 may be a fixed wireless network, a wireless local area network (LAN), a wireless wide area network (WAN) a personal area network (PAN), a virtual private network (VPN), intranet or other suitable network system and includes equipment for receiving and transmitting signals.

If the computer 401 is a PC, workstation, intelligent device or the like, the software in the memory 410 may further include a basic input output system (BIOS) (omitted for simplicity). The BIOS is a set of essential software routines that initialize and test hardware at startup, start the OS 411, and support the transfer of data among the hardware devices. The BIOS is stored in ROM so that the BIOS can be executed when the computer 401 is activated.

When the computer 401 is in operation, the processor 405 is configured to execute software stored within the memory 410, to communicate data to and from the memory 410, and to generally control operations of the computer 401 pursuant to the software. The DALI control methods described herein and the OS 411, in whole or in part, but typically the latter, are read by the processor 405, perhaps buffered within the processor 405, and then executed.

When the systems and methods described herein are implemented in software, as is shown in FIG. 4, the methods can be stored on any computer readable medium, such as storage 420, for use by or in connection with any computer related system or method.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing.

More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages.

The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures.

For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

In exemplary embodiments, where the DALI control methods are implemented in hardware, the DALI control methods described herein can implemented with any or a combination of the following technologies, which are each well known in the art: a discrete logic circuit(s) having logic gates for implementing logic functions upon data signals, an application specific integrated circuit (ASIC) having appropriate combinational logic gates, a programmable gate array(s) (PGA), a field programmable gate array (FPGA), etc.

CONCLUSION

By implementing the systems and methods described herein are able to meet strict power consumption limits during standby power, the limits for which are becoming stricter in various countries.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

For example, various aspects of the present invention can be implemented by software, firmware, hardware (or hardware represented by software such, as for example, hardware description language instructions), or a combination thereof. After reading this description, it will become apparent to a person skilled in the relevant art how to implement the invention using other computer systems and/or computer architectures.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

What is claimed is:

1. A system for reducing power consumption in a lighting interface, the system comprising:

a processor having a plurality of pins including at least one digital pin;

a transistor having a gate coupled to the processor; and a resistive network coupled to the processor and the transistor, wherein the processor controls the at least one digital pin of the plurality of pins, being an output during a normal operation, and being an input during a standby operation wherein the resistive network is adjusted to increase impedance at the gate and lower the power consumption during the standby operation.

2. The system of claim 1, wherein the resistive network comprises:

a first resistor electrically connected between a power supply and the gate of the transistor; and a second resistor configured to be connected to the processor.

3. The system of claim 2, wherein the lighting interface is a digital addressable lighting interface (DALI).

4. The system of claim 3, wherein the transistor is configured to transmit the DALI message received at the gate to the processor by opening and closing in response to the signal at the gate to allow the processor to receive the digital DALI message.

5. The system of claim 4, wherein at least one digital pin configured as the output pin is driven high, wherein the processor is configured to switch the second resistor out, to allow increased current to flow from the power supply into the gate of the transistor.

6. The system of claim 4, wherein the at least one digital pin configured as the input pin is driven to increase an impedance of the input pin, thereby electrically removing the second resistor from the resistive network.

7. The system of claim 4, wherein the first voltage signal is 0-5 volts.

8. The system of claim 3, wherein the transistor is configured to transmit the DALI message that it sees at its gate to the processor by opening and closing in response to the signal at the gate to allow the processor to receive the digital DALI message.

9. A method for reducing power consumption in a lighting interface, the method comprising:

configuring a processor having a plurality of pins including at least one digital pin, to be in a normal mode to send and receive lighting messages responsive a first voltage signal from a transistor coupled to the processor, thereby placing a lighting interface in a normal operating mode and turning on a luminaire; and configuring the processor to be in a standby mode with reduced power consumption to send and receive lighting messages, responsive to a second voltage signal from the transistor indicating, thereby placing the lighting interface into a reduced power mode and turning off the luminaire wherein the processor adjusts a resistive network connected with the at least one digital pin, to increase impedance at the transistor to lower the power consumption during the standby mode.

10. The method of claim 9, wherein the lighting interface is a digital addressable lighting interface (DALI).

11. The method of claim 10, wherein configuring the processor to be in the normal mode, comprises:

opening the transistor so that a first voltage is sent to the processor; and setting the at least one digital pin as an output pin wherein a first resistor and a second resistor are connected, with the at least digital pin being connected with the second resistor, thereby increasing a current flow to the transistor.

12. The method of claim 10, wherein configuring the processor to be in the standby mode, comprises:

opening the transistor so that a first voltage is sent to the processor; and setting the at least one digital pin as an input pin to increase the impedance of a second resistor to effectively remove the second resistor from operation with a first resistor.

13. The method of claim 12, wherein the first voltage signal is 0-5 volts.

14. The method of claim 12, further comprising, responsive to receiving a DALI message in the processor, setting via the processor the at least one digital pin as an output pin and switching the second resistor out thereby increasing a current flow to the transistor.

15. A system for reducing power consumption in a digital addressable lighting interface (DALI), the system comprising:

a light emitting diode (LED) driver;

a DALI controller communicatively coupled to the LED driver; and a luminaire coupled to the LED driver, wherein the LED driver comprises a plurality of pins including at least one digital pin of the plurality of pins which is configured to be an output during a normal operation, and to be an input during a standby operation, wherein a resistive network including a first resistor and a second resistor that are connected, with the at least one digital pin being connected with the second resistor, wherein during standby operation, the second resistor is switched out to increase impedance at the gate and lower the power consumption.

16. The system of claim 15, wherein the LED driver further comprises:

a transistor coupled to the processor;

a first resistor connected to the transistor; and a second resistor configured to be connected to the processor.

17. The system of claim 16, wherein the processor is configured to be in a normal mode to send and receive lighting messages responsive a first voltage signal from the transistor coupled to the processor, thereby placing the DALI in a normal operating mode and turning on the luminaire.

18. The system of claim 17, wherein the at least one digital pin is configured as an output pin and driven high to the transistor thereby configuring the first resistor to operate in connection with the second resistor in the resistive network.

19. The system of claim 17, wherein the at least one digital pin is configured an input pin thereby electrically removing the second resistor from the resistive network.

20. The system of claim 16, wherein the processor is configured to be in a standby mode with reduced power consumption to send and receive lighting messages, responsive to a second voltage signal from the transistor indicating, thereby placing the lighting interface into a reduced power mode and turning off the luminaire.

* * * * *